US008136917B2

(12) United States Patent
Sakurai

(10) Patent No.: US 8,136,917 B2
(45) Date of Patent: Mar. 20, 2012

(54) IMAGE FORMING APPARATUS AND IMAGE FORMING SYSTEM

(75) Inventor: Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 765 days.

(21) Appl. No.: 12/283,349

(22) Filed: Sep. 11, 2008

(65) Prior Publication Data

US 2009/0066737 A1 Mar. 12, 2009

(30) Foreign Application Priority Data

Sep. 12, 2007 (JP) ..... 2007-236531

(51) Int. Cl.
*B41J 2/165* (2006.01)

(52) U.S. Cl. ..... 347/23

(58) Field of Classification Search ..... None
See application file for complete search history.

(56) References Cited

U.S. PATENT DOCUMENTS

| | | | | |
|---|---|---|---|---|
| 5,018,884 | A * | 5/1991 | Hirano et al. | 347/30 |
| 5,266,975 | A * | 11/1993 | Mochizuki et al. | 347/23 |
| 5,475,404 | A | 12/1995 | Takahashi et al. | |
| 5,896,143 | A | 4/1999 | Matsui et al. | |
| 6,338,540 | B1 | 1/2002 | Hasegawa et al. | |
| 6,517,184 | B1 | 2/2003 | Bruch et al. | |
| 6,565,179 | B1 | 5/2003 | Bruch et al. | |
| 6,749,282 | B2 * | 6/2004 | Kohno | 347/23 |
| 6,814,422 | B2 | 11/2004 | Bruch et al. | |
| 7,440,124 | B2 * | 10/2008 | Tabuchi | 358/1.14 |
| 2006/0164475 | A1 | 7/2006 | Umeda et al. | |
| 2006/0284922 | A1 * | 12/2006 | Beak | 347/23 |

FOREIGN PATENT DOCUMENTS

| | | | |
|---|---|---|---|
| JP | 4027558 | | 1/1992 |
| JP | 4-049049 | | 2/1992 |
| JP | 7-68795 | | 3/1995 |
| JP | 8-174863 | | 7/1996 |
| JP | 9-109421 | | 4/1997 |
| JP | 09267469 | A * | 10/1997 |
| JP | 10315489 | | 12/1998 |
| JP | 2000-127447 | | 5/2000 |
| JP | 2000-238274 | | 9/2000 |
| JP | 2001-162828 | | 6/2001 |
| JP | 2003/231272 | | 8/2003 |
| JP | 2006/240224 | | 9/2006 |
| JP | 2007/105997 | | 4/2007 |

* cited by examiner

*Primary Examiner* — Stephen Meier
*Assistant Examiner* — Tracey McMillion
(74) *Attorney, Agent, or Firm* — Frommer Lawrence & Haug LLP

(57) ABSTRACT

An image forming apparatus includes: a liquid jetting head jetting a liquid to form an image; a recovery mechanism discharging the liquid in the liquid jetting head to an external part to recover jetting performance of the liquid jetting head; a controller controlling an operation of the recovery mechanism; and an information obtaining section obtaining predetermined information, wherein the controller controls the recovery mechanism according to the predetermined information obtained by the information obtaining section.

37 Claims, 12 Drawing Sheets

YOUR EXPECTED USAGE

1. DO YOU SWITCH OFF POWER ONCE A WEEK OR MORE?
   YES NO

2. IS THE NUMBER OF PRINTING COPIES YOU MAKE 30 SHEETS PER MONTH OR MORE?
   YES NO

3. DO YOU MAINLY USE MONOCHROME PRINTING?
   YES NO

4. DO YOU MAINLY USE COLOR PRINTING?
   YES NO
   (IF WHICH OF MONOCHROME OR COLOR PRINTING IS MAINLY USED IS INDEFINITE, SELECT "NO")

5. .....

IMAGE FORMING APPARATUS AND IMAGE FORMING SYSTEM

CROSS REFERENCE TO RELATED APPLICATION

The present application claims priority from Japanese Patent Application No. 2007-236531, filed on Sep. 12, 2007, the disclosure of which is incorporated herein by reference in its entirety.

BACKGROUND OF THE INVENTION

1. Field of the Invention

The present invention relates to an image forming apparatus and an image forming system forming an image by jetting liquid from nozzles.

2. Description of the Related Art

In an inkjet printing apparatus, in order to constantly maintain and recover a good ink jetting function, a suction mechanism which sucks a nozzle-surface discharges ink of which viscosity has increased in jetting nozzles (so-called purge operation). In an inkjet recording apparatus described in Japanese Patent Application Laid-open No. 9-109421, the maintenance or recovery operation is performed to a recording head or recording heads designated by a host computer, among a plurality of recording heads. Further, in an inkjet recording apparatus described in Japanese Patent Application Laid-open No. 7-68795, the suction recovery is performed only to a recording head or recording heads selected from a plurality of recording heads, under a suction condition such as an initial suction pressure, a suction amount, and a suction interval specifically set for each of the recording heads.

In an apparatus performing the maintenance or recovery operation at a predetermined cycle or the like, such as a typical inkjet printing apparatus, the maintenance or recovery operation is set on assumption that the worst state, among user's usage affecting the jetting performance of the recording head, would occur. Therefore, depending on the user's usage, ink is consumed more than necessary at the time of the maintenance or recovery operation.

For example, since the length of a power-off period cannot be usually measured, the recovery operation is performed when the apparatus is switched on based on the assumption that the apparatus has not been used for a long time. However, if a user frequently switches on/off the power by inserting/pulling a power plug, performing the recovery operation every time the apparatus is switched on results in wasteful ink consumption.

Further, viscosity increase of ink progresses differently depending on the use frequency of mediums, for example, depending on whether a large number of printing copies are frequently made, and setting the recovery operation according to a user whose use frequency of mediums is low results in wasteful ink consumption for a user who use mediums frequently.

Further, in an apparatus including a plurality of recording heads, ink not used by a user is also consumed by the maintenance or recovery operation performed at a predetermined cycle. Therefore, as described in Japanese Patent Application Laid-open No. 9-109421 and Japanese Patent Application Laid-open No. 7-68795, it has been proposed to set the maintenance or recovery operation according to the user's designation of a recording head or recording heads, thereby avoiding the consumption of a more than necessary amount of ink which has not been used much. However, in the apparatuses described in Japanese Patent Application Laid-open No. 9-109421 and Japanese Patent Application Laid-open No. 7-68795, since the maintenance or recovery operation is performed to the designated recording head or recording heads, the user has to check the printing result to judge whether the maintenance or recovery operation of each of the recording heads is necessary, or to adjust the setting for each of the recording heads according to printing data, which is difficult for an ordinary user.

SUMMARY OF THE INVENTION

It is an object of the present invention to provide an image forming apparatus and an image forming system in which viscosity increase of liquid can be appropriately solved based on a user's usage of the apparatus or the system, such as a power on/off frequency of the apparatus, a use frequency of each liquid when a plurality of kinds of liquids are used, a use frequency of mediums, or the like.

According to a first aspect of the present invention, there is provided an image forming apparatus including: a liquid jetting head which jets a liquid to form an image; a recovery mechanism which recovers jetting performance of the liquid jetting head by discharging the liquid in the liquid jetting head to outside of the liquid jetting head; a controller which controls an operation of the recovery mechanism; and an information obtaining section which obtains predetermined information, wherein the controller controls the recovery mechanism based on the predetermined information obtained by the information obtaining section.

In the liquid jetting head, in order to prevent the jetting performance from changing due to viscosity increase of the liquid inside, it is necessary to periodically discharge the liquid in the liquid jetting head outside the liquid jetting head by the recovery mechanism. However, if the liquid is indiscriminatingly discharged irrespective of the usage of the image forming apparatus, there is a risk that the liquid may be discharged more than necessary. In the present invention, since the recovery mechanism is controlled based on the predetermined information obtained by the information obtaining unit, it is possible to prevent the liquid from being discharged more than necessary in order to maintain or recover the jetting performance.

In the image forming apparatus of the present invention, the predetermined information may be a usage of the image forming apparatus, and the information obtaining section may include a usage detecting section which detects the usage of the image forming apparatus. In this case, since the recovery mechanism is controlled based on the usage detected by the usage detecting section, it is possible to prevent the liquid from being discharged more than necessary in order to maintain or recover the jetting performance.

In the image forming apparatus of the present invention, the usage detecting section may include a detecting section which detects a power on/off frequency of the image forming apparatus, and in a case that the power on/off frequency is not more than a predetermined frequency, the controller may control the recovery mechanism to discharge the liquid in the liquid jetting head when the image forming apparatus is switched on, and in a case that the power on/off frequency is greater than the predetermined frequency, the controller may control the recovery mechanism not to discharge the liquid in the liquid jetting head when the image forming apparatus is switched on. That is, when the power on/off frequency is low, a period from a switched-off time up to the next switch-on time is thought to be long. Therefore, the recovery operation is performed when the apparatus is switched on, thereby discharging the liquid of which viscosity has increased in the liquid jetting head during the period. On the other hand, when a user frequently switches on/off the power of the apparatus by, for example, inserting/pulling a power plug, the period from the switched-off time up to the next switch-on time is thought to be short. Therefore, the viscosity of the liquid in the liquid jetting head does not increase very much during the period. Accordingly, the recovery mechanism is controlled not to discharge the liquid in the liquid jetting head when the apparatus is switched on. This can prevent the wasteful discharge of the liquid since the wasteful recovery operation is not performed.

In the image forming apparatus of the present invention, the usage detecting section may include a detecting section which detects a usage of the image forming apparatus based on data for forming the image, and the controller may control the recovery mechanism based on the usage of the image forming apparatus detected based on the data for forming the image. In this case, the usage of the image forming apparatus is detected based on the data for forming the image, and the recovery operation can be performed in proper degree based on the usage.

In the image forming apparatus of the present invention, the liquid includes a plurality of kinds of liquids; the liquid jetting head may be provided as a plurality of liquid jetting heads for the plurality of kinds of liquids respectively; the usage detecting section may include a detecting section which detects a use frequency of each of the liquids, the controller may control the recovery mechanism to recover the jetting performance of each of the liquid jetting heads at a predetermined recovery cycle; and when the use frequency of a liquid among the liquids is greater than the use frequency of the other liquids, the controller may control the recovery mechanism to make a recovery cycle, of a liquid jetting head among the liquid jetting heads corresponding to the liquid of which use frequency is greater, longer than the predetermined recovery cycle. When the liquid jetting heads is provided as a plurality of liquid jetting heads for the plurality of kinds of liquids respectively, a liquid of which use frequency is greater suffers less viscosity increase since it is used more frequently than the other liquids. Therefore, the recovery cycle of the liquid jetting head of the liquid can be made longer than the regular recovery cycle. This can prevent the liquid from being discharged more than necessary from the liquid jetting head by the recovery operation.

In the image forming apparatus of the present invention, the usage detecting section may include a detecting section which detects a use frequency of a medium receiving the liquid jetted from the liquid jetting head; the controller may control the recovery mechanism to recover the jetting performance of the liquid jetting head at a predetermined recovery cycle; and when the use frequency of the medium is greater than a predetermined value, the controller may control the recovery mechanism to make a recovery cycle longer than the predetermined recovery cycle. That is, when the use frequency of the medium is greater than the predetermined value, the liquid moves in the liquid jetting head more than when the use frequency of the medium is low. Thus suffers less viscosity increase, and therefore, the recovery cycle can be made longer than the regular recovery cycle. This can prevent the liquid from being discharged more than necessary from the liquid jetting head by the recovery operation.

In the image forming apparatus of the present invention, the predetermined information may be a power on/off frequency of the image forming apparatus, the information obtaining section may include an input section via which the power on/off frequency is inputted, and in a case that the power on/off frequency is not more than a predetermined frequency, the controller may control the recovery mechanism to discharge the liquid in the liquid jetting head when the image forming apparatus is switched on, and in a case that the power on/off frequency is greater than the predetermined frequency, the controller may control the recovery mechanism not to discharge the liquid in the liquid jetting head when the image forming apparatus is switched on. In this case, since the power on/off frequency is inputted by a user via the input section, the recovery operation can be controlled based on the user's switch-on operation. Specifically, when the power on/off frequency is low, a period from the switched-off time up to the next switch-on time is thought to be long. Therefore, the recovery operation is performed when the apparatus is switched on, thereby discharging the liquid of which viscosity has increased in the liquid jetting head during the period. On the other hand, when a user frequently switches on/off the power of the apparatus by, for example, inserting/pulling a power plug, the period from the switched-off time up to the next switch-on time is thought to be short, and therefore, the viscosity of the liquid in the liquid jetting head does not increase very much during the period. Accordingly, by controlling the recovery mechanism not to discharge the liquid in the liquid jetting head when the apparatus is switched on, it is possible to prevent the wasteful discharge of the liquid since the wasteful recovery operation is not performed.

In the image forming apparatus of the present invention, the liquid may include a plurality of kinds of liquids; the liquid jetting head may be provided as a plurality of liquid jetting heads for the plurality of kinds of liquids respectively; the predetermined information may be a relative use frequency of each of the liquids, the information obtaining section may include an input section via which the relative use frequency of each of the liquids is input, the controller may control the recovery mechanism to recover the jetting performance of each of the liquid jetting heads at a predetermined cycle, and when the use frequency of a liquid among the liquids is greater than the use frequency of the other liquids, the controller may control the recovery mechanism to make a recovery cycle, of a liquid jetting head among the liquid jetting heads corresponding to the liquid of which use frequency is greater, longer than the predetermined recovery cycle. When the liquid jetting heads are provided for the plurality of kinds of liquids respectively, the recovery operation can be controlled separately for the liquids, based on the relative use frequencies of the liquids inputted via the input part. That is, the liquid of which use frequency is great suffers less viscosity increase since the liquid moves more than the other liquids and thus the recovery cycle of the liquid jetting head corresponding to the liquid can be made longer than the regular recovery cycle. This can prevent the liquid from being discharged more than necessary from the liquid jetting head by the recovery operation.

In the image forming apparatus of the present invention, the predetermined information may be a use frequency of a medium receiving the liquid jetted from the liquid jetting head; the information obtaining section may include an input section via which the use frequency of the medium receiving the liquid jetted from the liquid jetting head is inputted; the controller may control the recovery mechanism to recover the jetting performance of the liquid jetting head at a predetermined cycle; and when the use frequency of the medium is greater than a predetermined value, the controller may control the recovery mechanism to make a recovery cycle longer than the predetermined recovery cycle. In this case, the recovery operation can be controlled based on the use frequency of the medium inputted via the input section. That is, when the use frequency of the medium is greater than the predetermined value, since the liquid moves more, the liquid suffers less viscosity increase than when the use frequency of the medium is low. Therefore, the recovery cycle can be made longer than the regular recovery cycle. This can prevent the liquid from being discharged more than necessary from the liquid jetting head by the recovery operation.

According to a second aspect of the present invention, there is provided an image forming system including: an image forming apparatus including a liquid jetting head which jets a liquid to form an image and a recovery mechanism which recovers jetting performance of the liquid jetting head by discharging the liquid in the liquid jetting head to outside of the liquid jetting head; and a controller which is connected to the image forming apparatus and which transmits, to the image forming apparatus, data with which the image forming apparatus forms the image. In a system in which the controller, for example, a personal computer transmits data to the image forming apparatus and the image forming apparatus jets liquids to form an image based on the data, the controller can control a recovery operation of the image forming apparatus based on a usage of the image forming apparatus inputted into the controller.

In the image forming system of the present invention, the controller may include a usage detecting section which detects a usage of the image forming apparatus, and the controller may transmit, to the image forming apparatus, a signal controlling the recovery mechanism based on the usage of the image forming apparatus which is detected by the usage detecting section. In the system in which the controller, for example, a personal computer transmits data to the image forming apparatus and the image forming apparatus jets liquids to form an image based on the data, the controller can control the recovery operation based on the usage of the image forming apparatus detected by the controller.

In the image forming system of the present invention, the image forming apparatus may include a usage detecting section which detects a usage of the image forming apparatus, and the controller may transmit, to the image forming apparatus, a signal controlling the recovery mechanism based on the usage of the image forming apparatus which is detected by the usage detecting section and received from the image forming apparatus. In the system in which the controller, for example, a personal computer transmits data to the image forming apparatus and the image forming apparatus jets liquids to form an image based on the data, the controller transmits, to the image forming apparatus, the signal controlling the recovery mechanism based on the usage of the image forming apparatus detected by the image forming apparatus, thereby capable of controlling the recovery operation based on the usage of the image forming apparatus.

In the image forming system of the present invention, the image forming apparatus and the controller may be connected to each other via a communication line, the image forming apparatus may include an input section via which a usage of the image forming apparatus is inputted, and the controller may transmit, to the image forming apparatus, a signal controlling the recovery mechanism based on the usage inputted from the image forming apparatus via the communication line. In the system in which the image forming apparatus has, for example, a facsimile function and is connected to the external controller via the communication line, the usage is inputted by a user to the image forming apparatus to be transmitted to the controller and then the controller transmits, to the image forming apparatus, the signal controlling the recovery operation of the image forming apparatus based on the usage of the image forming apparatus, thereby capable of controlling the recovery operation based on the usage of the image forming apparatus.

In the image forming system of the present invention, the image forming apparatus and the controller may be connected to each other via a communication line. In the system in which the image forming apparatus has, for example, a facsimile function and is connected to the external controller via the communication line, the image forming apparatus detects the usage of the image forming apparatus to transmit the usage to the controller, and then the controller transmits, to the image forming apparatus, the signal controlling the recovery operation of the image forming apparatus based on the usage of the image forming apparatus, thereby capable of controlling the recovery operation based on the usage of the image forming apparatus.

In the image forming system of the present invention, the controller may be connected to the image forming apparatus and may include a first controller which transmits, to the image forming apparatus, data for forming the image and a second controller connected to the first controller via a communication line; the image forming apparatus may include a detecting section which detects a usage of the image forming apparatus; the first controller may output, to the second controller, the usage inputted from the image forming apparatus; and the second controller may transmit a signal controlling the recovery mechanism based on the usage, to the image forming apparatus via the first controller. In the system in which the image forming apparatus is connected to the first controller such as, for example, a personal computer and the first controller is connected to the external second controller via the communication line such as the Internet, the image forming apparatus detects the usage of the image forming apparatus to transmit the usage to the second controller via the first controller. The second controller transmits the signal controlling the recovery operation of the image forming apparatus based on the usage of the image forming apparatus, to the image forming apparatus via the first controller, thereby capable of controlling the recovery operation based on the usage of the image forming apparatus.

In the image forming system of the present invention, the controller may be connected to the image forming apparatus and may include a first controller which transmits, to the image forming apparatus, data for forming the image and a second controller connected to the first controller via a communication line; the first controller may include an input section via which a usage of the image forming apparatus is inputted, and the first controller may output, to the second controller, the usage inputted via the input section, and the second controller may transmit a signal controlling the recovery mechanism based on the usage, to the image forming apparatus via the first controller. In the system in which the image forming apparatus is connected to the first controller such as, for example, a personal computer and the first controller is connected to the external second controller via the communication line such as the Internet, a user inputs the usage of the image forming apparatus via the first controller and the first controller transmits the usage to the second controller. The second controller transmits, the signal controlling the recovery operation of the image forming apparatus based on the usage of the image forming apparatus, to the image forming apparatus via the first controller, thereby capable of controlling the recovery operation of the image forming apparatus based on the usage of the image forming apparatus.

In the image forming system of the present invention, the usage of the image forming apparatus may include a power on/off frequency of the apparatus, a use frequency of each liquid of among a plurality of kinds of liquids, or a use frequency of a medium.

DETAILED DESCRIPTION OF THE PREFERRED EMBODIMENTS

Hereinafter, preferable embodiments of the present invention will be described.

Figure 1:
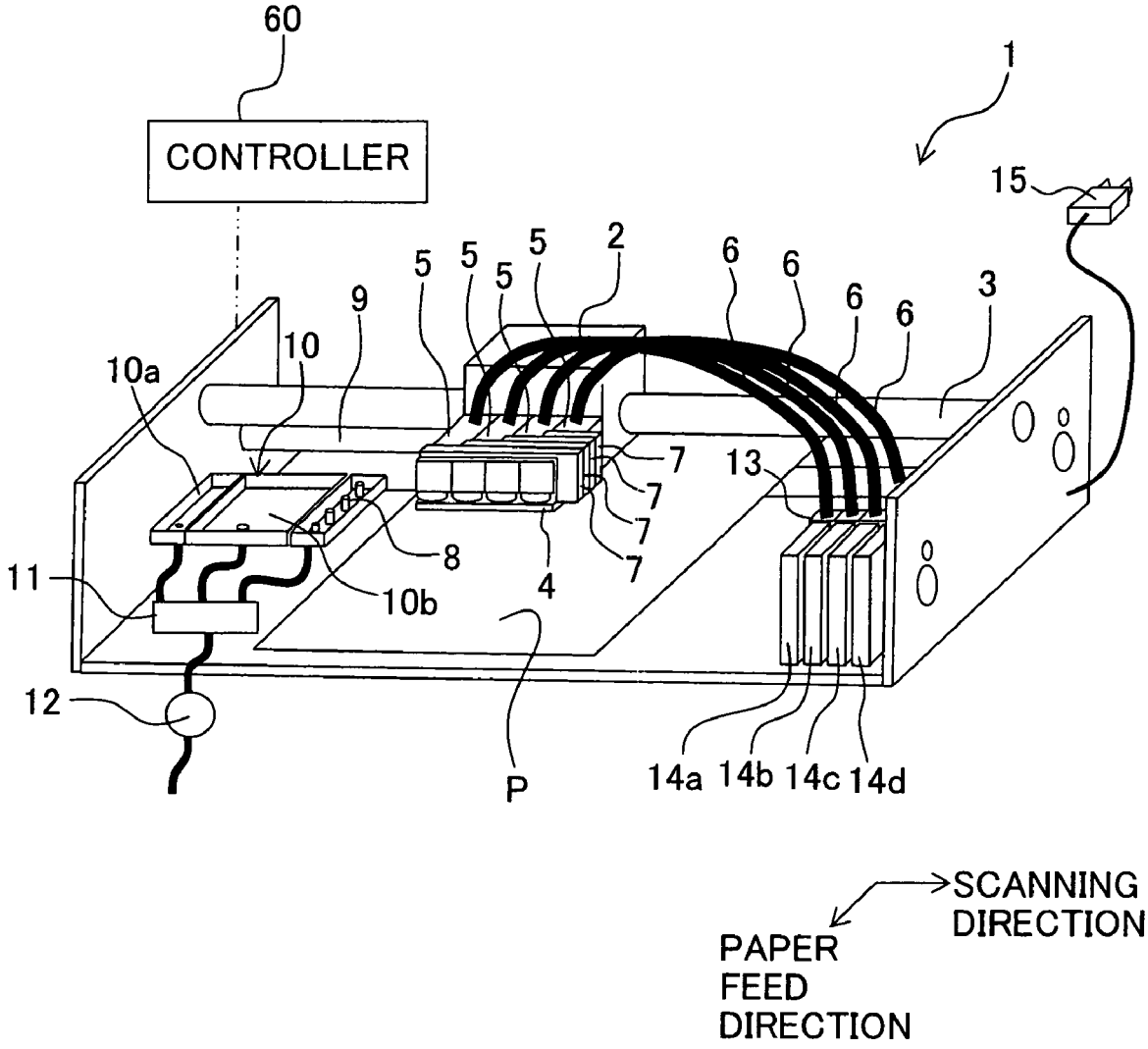
FIG. 1 is a view showing a rough structure of a printer common to embodiments.

FIG. 1 is a view showing a rough structure of a printer (liquid jetting apparatus) common to the embodiments. As shown in FIG. 1, the printer 1 includes a main scanning device which reciprocates a liquid jetting head, that is, an inkjet head 4 parallel to recording paper P as an image formation medium, a transporting device transporting the recording paper P in a direction perpendicular to the direction in which the inkjet head 4 reciprocates, an ink supply device supplying image forming liquid, that is, ink to the inkjet head 4, a recovery device (recovery mechanism) recovering a jetting function of the inkjet head 4, a controller 60 controlling the operations of these components, a power plug 15 via which operating power is supplied to these components, and so on.

The main scanning device includes a carriage 2 on which the inkjet head 4 is mounted, and reciprocates the carriage 2 along a guide shaft 3 in the right/left direction in FIG. 1 which is a scanning direction. The inkjet head 4 has nozzles 25 (see FIG. 2) which are exposed to a lower surface of the carriage 2, and jets the ink toward the paper P from the nozzles 25 while reciprocating in the scanning direction with the carriage 2.

Above the inkjet head 4, four sub-tanks 5 are attached to the carriage 2. The sub-tanks 5 contain, from the left in FIG. 1, black, yellow, cyan, and magenta inks respectively, and supply these inks to the inkjet head 4.

The ink supply device is composed of four ink cartridges 14*a* to 14*d* attached to a stationary part 13 outside the carriage 2 in the inkjet printer 1, the four sub-tanks 5 mounted on the carriage 2, and four tubes 6 connecting the ink cartridges 14*a* to 14*d* and the sub-tanks 5 respectively. The ink cartridges 14*a* to 14*d* are filled with the black, yellow, cyan, and magenta inks respectively, and these inks of the four colors are supplied from the ink cartridges 14*a* to 14*d* to the sub-tanks 5 and further supplied from the sub-tanks 5 to the inkjet head 4 respectively.

The transporting device includes a paper feed roller 9 transporting the recording paper P at a position under the nozzles 25 of the inkjet head 4 in a direction (paper feed direction) perpendicular to the scanning direction of the carriage 2.

Figure 3A:
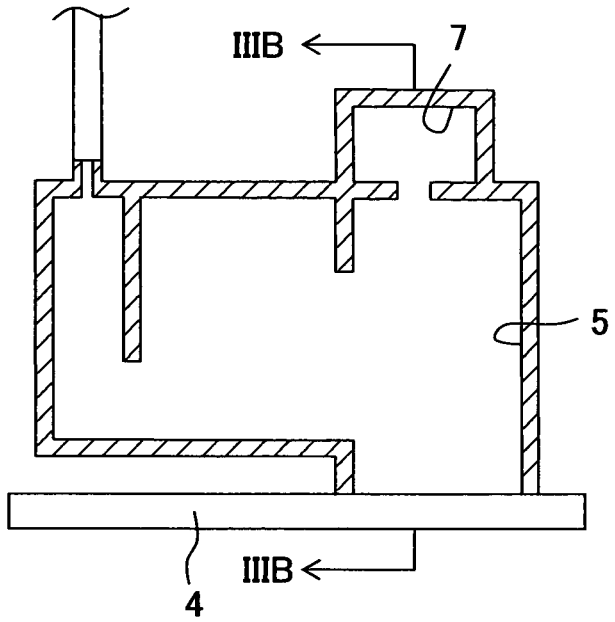
FIG. 3A is a vertical sectional view of the inkjet head and a sub-tank in FIG. 1.
Figure 3B:
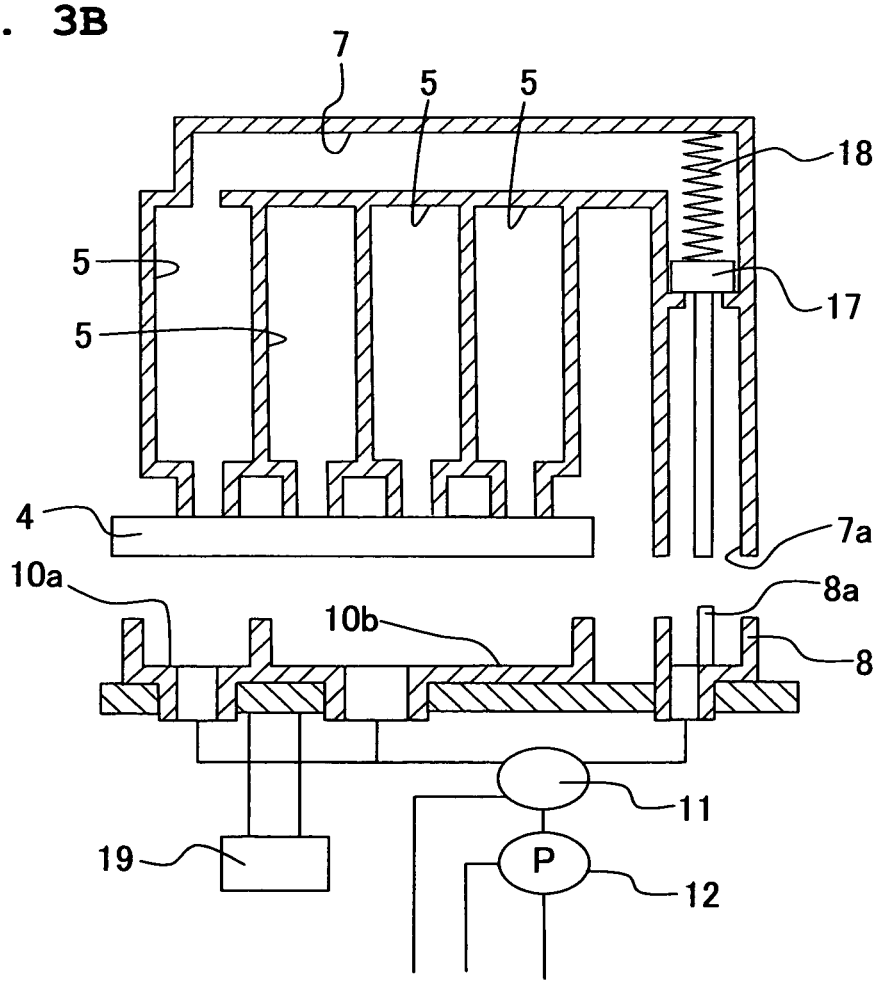
FIG. 3B is a cross-sectional view taken along line IIIB-IIIB in FIG. 3A and a cross-sectional view of a cap corresponding thereto.

The recovery device performs a purge operation, an air discharge operation, and a flashing operation as is generally known. For the air discharge operation, air discharge channels 7 extending right from upper surfaces of the sub-tanks 5 with right ends thereof bending down at a substantially right angle are provided on the sub-tanks 5, as shown in FIG. 3. The four air discharge channels 7 have lower ends 7*a* which are opened to the outside on a side of the inkjet head 4, and have therein valves 17 respectively. The valves 17 normally close the air discharge channels 7 with respect to the outside by the operation of springs 18.

In the printer 1, air discharge cap 8 and a purge cap 10 are provided on a side of the area where the recording paper P is transported. The air discharge cap 8 and the purge cap 10 are movable up/down by a lift mechanism 19, and when they move up toward the carriage 2 which has moved to the outside of the position where the recording paper P is transported, the air discharge cap 8 comes into close contact with the openings of the lower ends 7*a* of the air discharge channels 7, and the purge cap 10 comes into close contact with the lower surface of the inkjet head 4. The air discharge cap 8 has therein push-up projections 8*a*, and when the air discharge cap 8 is connected to the openings of the lower ends 7*a* of the air discharge channels 7, the projections 8*a* push up the valves 17 open, so that the air discharge cap 8 is connected to upper spaces in the sub-tanks 5.

The purge cap 10 has a first capping part 10*a* and a second capping part 10*b*. When the purge cap 10 moves up as described above, the first capping part 10*a* covers the nozzles 25 of the black ink (to be described later) and the second capping part 10*b* covers the nozzles 25 of the color (yellow, cyan, and magenta) inks (to be described later). Incidentally, the air discharge cap 8, the first capping part 10*a*, and the second capping part 10*b* may be moved up/down by separate lift mechanisms respectively. The air discharge cap 8 and the projections 8*a* therein may be moved up/down by separate lift mechanisms respectively. Further, the valve 17 of the air discharge channel 7 connected to the sub-tank 5 of the black ink and the valves 17 of the air discharge channels 7 connected to the sub-tanks 5 of the three color inks may be separately opened/closed.

The air discharge cap 8, the first capping part 10*a*, and the second capping part 10*b* are connected to a suction pump 12 via a switching device 11. The switching device 11 switches between the connection of the air discharge cap 8, the first capping part 10*a*, and the second capping part 10*b* to the suction pump 12 and their disconnection from the suction pump 12.

When the suction pump 12 is operated while the air discharge cap 8 is connected to the air discharge channels 7 and the air discharge cap 8 and the suction pump 12 are connected by the switching device 11, air in the upper portions in the sub-tanks 5 is discharged to the outside.

When the suction pump 12 is operated while the purge cap 10 covers the nozzles 25 and the first capping part 10*a* and/or the second capping part 10*b* are/is connected to the suction pump 12 by the switching device 11, the purge operation is performed, that is, the ink in the inkjet head 4 is sucked out from the nozzles 25 jetting the black ink and/or the nozzles 25 jetting the color inks.

In order to recover the jetting performance of the inkjet head 4, the flashing operation is performed in such a manner that the carriage 2 moves to the position on the side of the position at which the recording paper P is transported, and in this state, the inkjet head 4 is driven to jet the inks from all the nozzles 25 toward the purge cap 10 or a known vessel (not shown), as is generally known. In this embodiment, it is also possible to perform the flashing operation of the nozzles 25 jetting the black ink separately from the flashing operation of the nozzles 25 jetting the three color inks.

Figure 2:
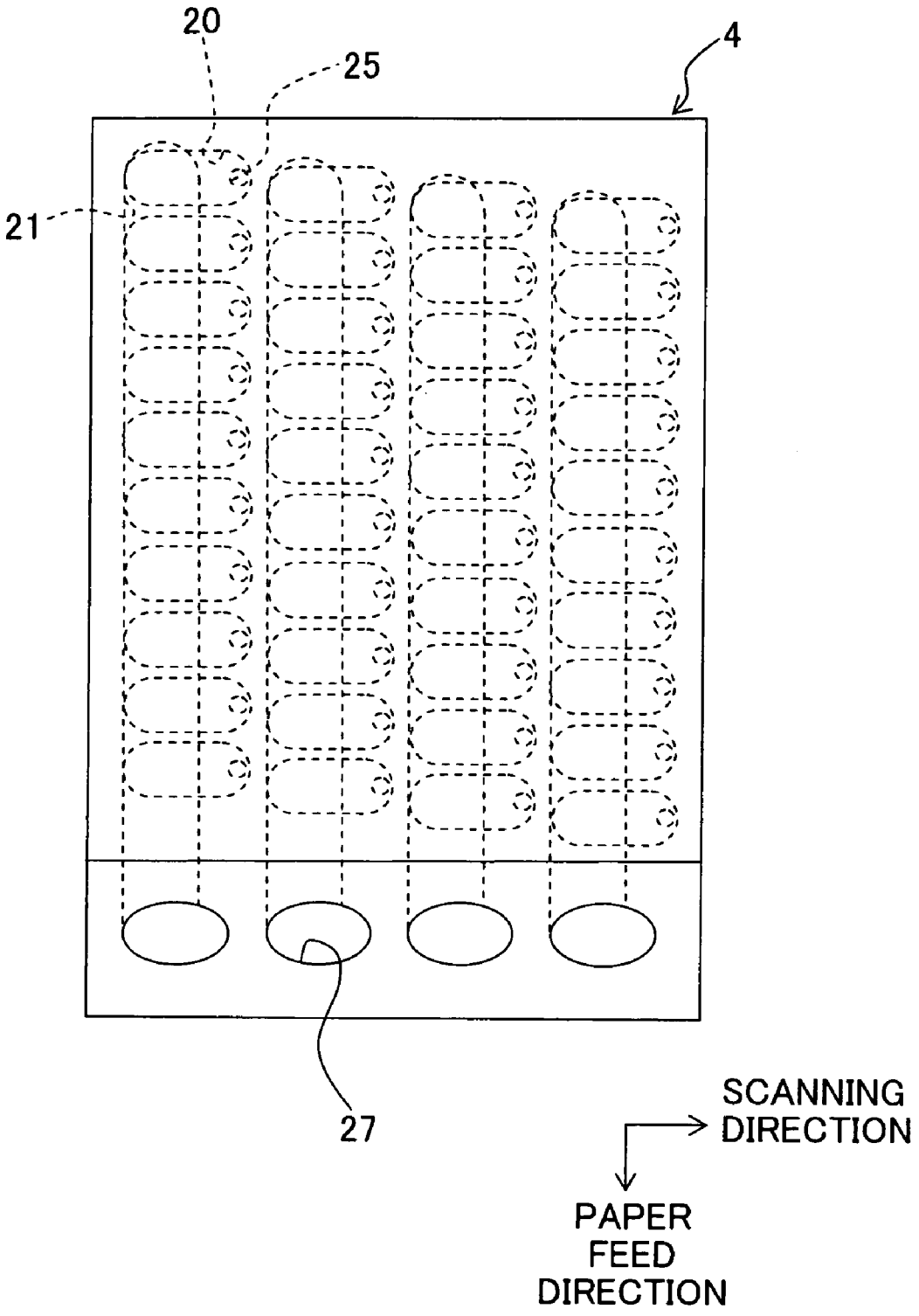
FIG. 2 is a plane view of an inkjet head in FIG. 1.

FIG. 2 shows an example of the inkjet head 4. Similarly to a generally known inkjet head, the inkjet head 4 has, on its lower surface facing the recording paper P, a large number of the nozzles 25 arranged in rows corresponding to the black, yellow, cyan, and magenta inks respectively, and the nozzles 25 in each row communicate, via pressure chambers 20, with a manifold channel 21 which is provided for each of the inks. Each of the manifold channels 21 has, at one end thereof, a supply port 27 communicating with the corresponding sub-tank 5 and distributes the ink supplied from the sub-tank 5 to the pressure chambers 20. The ink in the pressure chambers 20 is jetted in liquid droplet form toward the recording paper P from the nozzles 25 when jetting energy is applied thereto, as is generally known. As a mechanism for applying the jetting energy, a mechanism deforming piezoelectric elements, a mechanism foaming the ink by a heater, or the like is usable.

Figure 4:
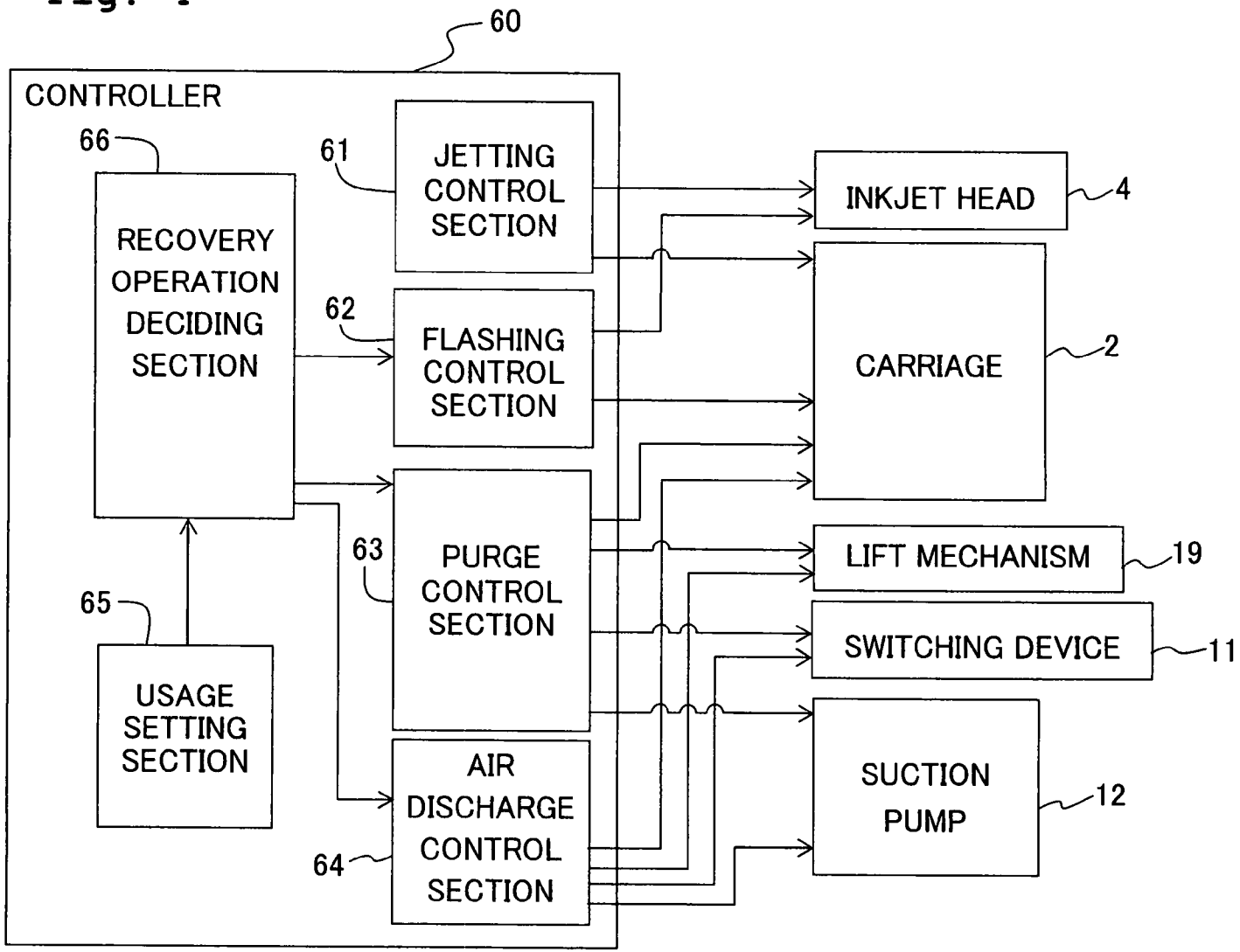
FIG. 4 is a block diagram of a controller in a first embodiment.

FIG. 4 is a block diagram schematically showing the controller 60 in the printer 1 of the first embodiment. The controller 60 includes a CPU (Central Processing Unit), a ROM (Read Only Memory), a RAM (Random Access Memory), and so on, and these components operate as a jetting control section 61, a flashing control section 62, a purge control section 63, an air discharge control unit 64, a usage setting section 65, and a recovery operation deciding section 66.

The jetting control section 61 controls the operations of the inkjet head 4, the carriage 2, and the paper feed roller 9 based on user data for printing or the like. The flashing control section 62 controls the operations of the inkjet head 4 and the carriage 2 at the time of the flashing operation.

The purge control section 63 controls the operations of the carriage 2, the switching device 11, the suction pump 12, and the lift mechanism 19 at the time of the purge operation. The air discharge control unit 64 controls the operations of the carriage 2, the switching device 11, the suction pump 12, and the lift mechanism 19 when an air in the sub-tanks 5 is discharged.

Figures 5A, 5B:
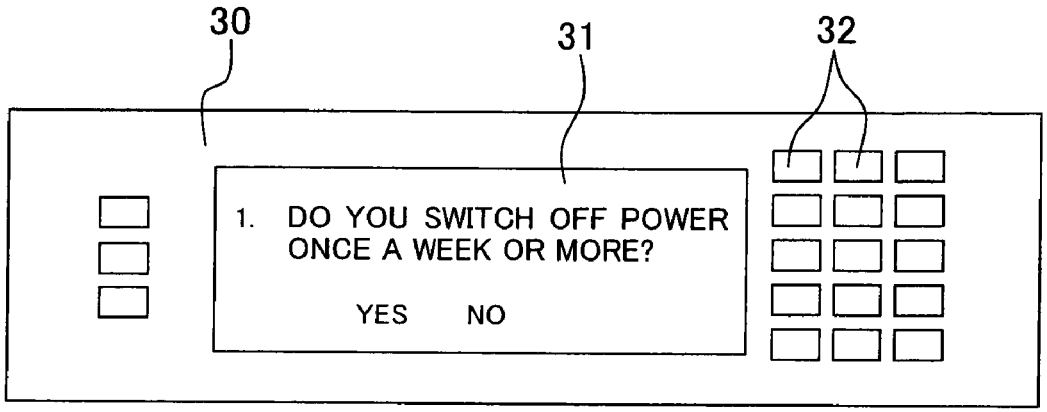
FIG. 5A is a plane view showing an input section of a usage setting section in FIG. 4.
FIG. 5B is a view used to explain a display example in the input section.

The usage setting section 65 (input section) is used as an information obtaining section for obtaining a user's usage of the printer 1, such as a power on/off frequency of the printer 1, frequencies of monochrome printing and color printing, and the number of printing copies. In the usage setting section 65, the user's usage is inputted from an operation section 32 such as keys, in response to messages displayed on a display 31 provided on an operation panel 30 of the printer 1 as shown in FIG. 5A. For example, "YES", "NO", or the like is inputted from the operation section 32 in reply to, for example, the following questions displayed on the display 31 as shown in FIG. 5B: "1. Do you switch off the power once a week or more?", "2. Is the number of printing copies you make 30 sheets per month or more?", "3. Do you mainly use monochrome printing?", and "4. Do you mainly use color printing?". These questions may be any, provided that they can give a rough view of an expected user's usage, before the user starts using the printer after purchasing it or when the user tries to change the past usage during a use period of the printer.

The recovery operation deciding section 66 sets the recovery operation according to the user's usage inputted into the usage setting section 65, and outputs the setting to nonvolatile memories of the flashing control section 62, the purge control section 63, and the air discharge control unit 64. The flashing control section 62, the purge control section 63, and the air discharge control unit 64 execute the flashing operation, the purge operation, and the air discharge operation respectively according to the settings stored in the respective memories.

For example, when a user frequently switches on/off the power of the printer 1 by inserting/pulling the power plug 15 to/from a commercial power source, by operating a power switch, or the like, the time length of a power-off period is not known if the printer does not have a function of measuring the time length of the power-off period. Therefore, the recovery operation has to be executed every time when the printer 1 is switched on (that is, every time when the printer 1 is connected to the commercial power source), resulting in the discharge of the ink more than necessary. However, the frequent power on/off of the printer 1 means that the time length from the switched-off time to the next switch-on time is not very long. Since the viscosity increase of the ink in the nozzles 25 is not thought to progress during this period, the recovery operation when the printer 1 is switched on can be omitted.

Further, when the number of printing copies per predetermined period in the printer 1 is large, viscosity increase of the ink is not thought to have progressed much since the ink is frequently jetted from the nozzles 25 and thus the ink in the nozzles 25 moves much. Therefore, if the recovery operation is performed at the same recovery cycle as that when the number of printing copies is small, the ink is discharged more than necessary.

Further, even if a printer is capable of monochrome printing and color printing, some user uses the printer mainly for the monochrome printing and makes a predetermined number of printing copies or more by the monochrome printing. In such a case, the ink in the nozzles 25 jetting the black ink moves more and thus suffers less viscosity increase compared with a case in which a user does not use the printer much for the monochrome printing. If the recovery operation is performed at a predetermined cycle in this state, the black ink is discharged more than necessary. In other words, when the printer is used mainly for the monochrome printing, the cycle of the recovery operation of the nozzles 25 jetting the black ink may be made long.

Conversely, when a user uses the printer mainly for the color printing and makes a predetermined number of printing copies or more by the color printing, the purge operation is performed in a state in which the viscosity of the inks in the nozzles 25 jetting the color inks has not been increased much, compared with a case in which a user does not use the printer much for the color printing, so that the color inks are discharged more than necessary. In other words, when the printer is used mainly for the color printing, the cycle of the recovery operation of the nozzles 25 jetting the color inks may be made long. Here, in a printer which uses only the three yellow, cyan, and magenta inks for the color printing, the recovery operation of the nozzles of these three color inks is controlled, but in a printer using the black ink in addition to these color inks for the color printing, the recovery operation of the nozzles including the nozzles of the black ink is controlled.

Figure 6A:
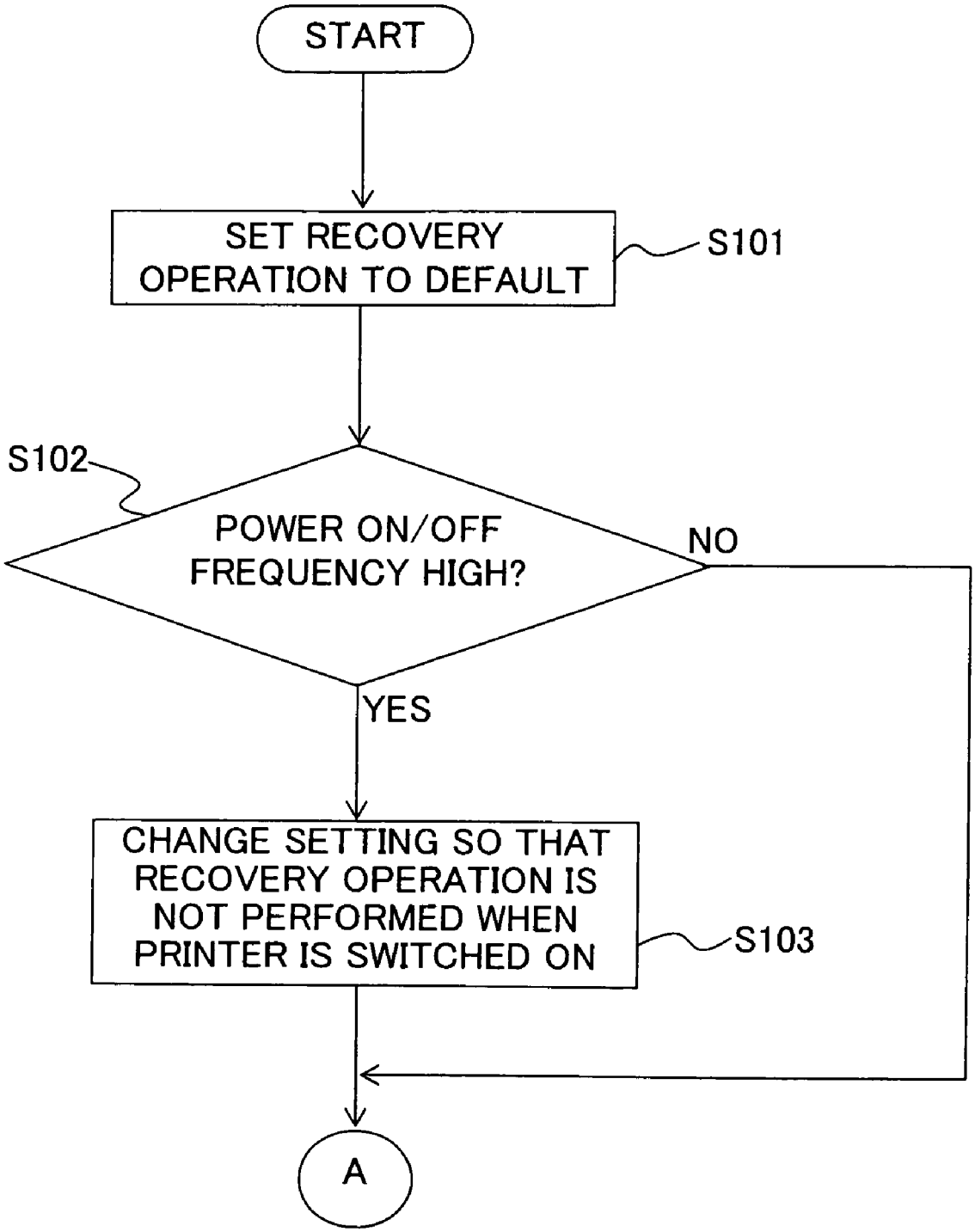
FIGS. 6A and 6B are a flowchart showing an essential part of a control flow.
Figure 6B:
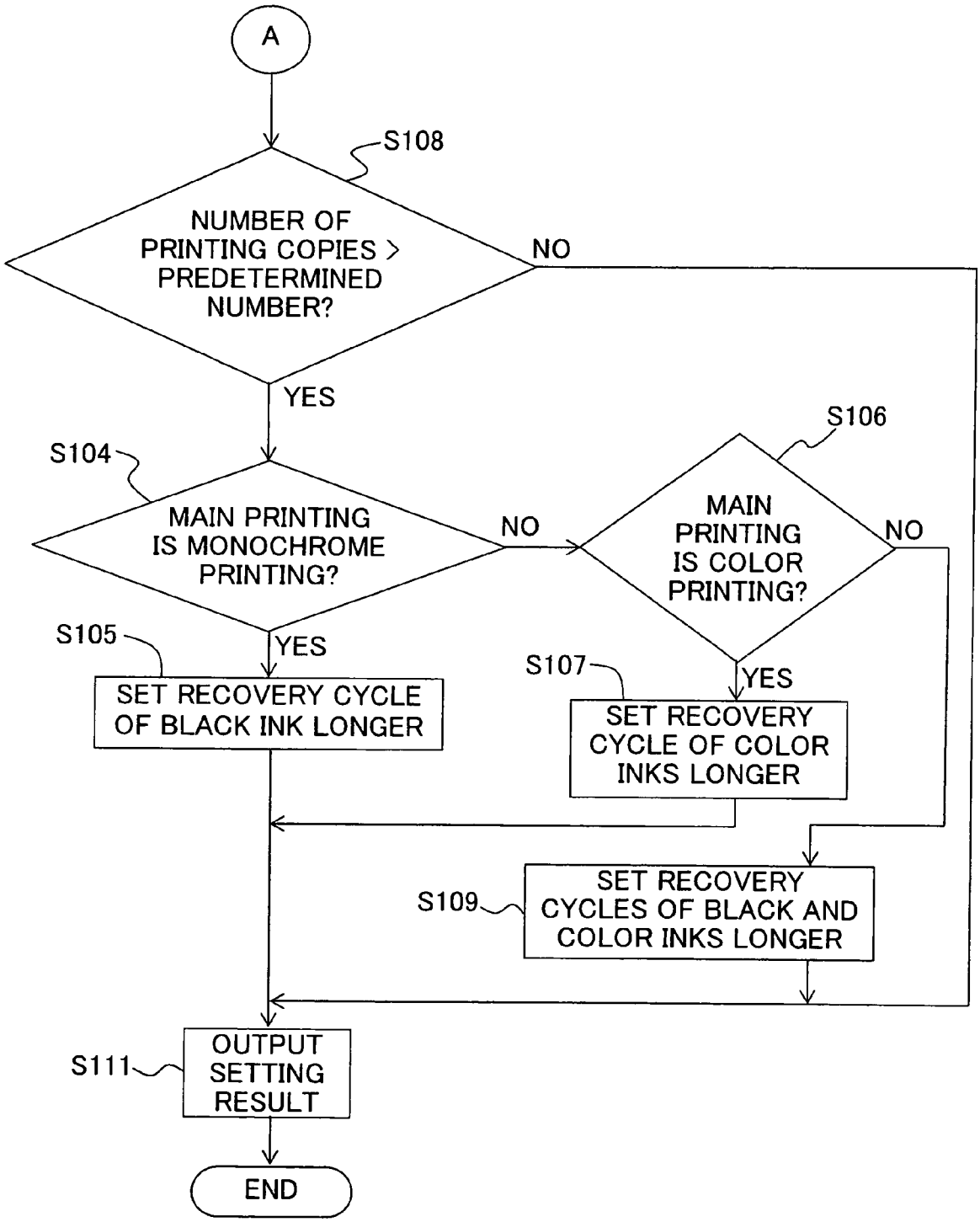

FIGS. 6A and 6B are a flowchart when the recovery operation deciding section 66 decides the recovery operation.

In the recovery operation deciding section 66, the recovery operation is set to defaults in an initial state (S101). Here, the defaults are set so that the flashing control section 62, the purge control section 63, and the air discharge control unit 64 execute the flashing operation, the pure operation, and the air discharge operation respectively, at a predetermined cycle or based on the elapsed time from the latest flashing, purge, and air discharge operations, as is generally known. These predetermined cycle and elapsed time are different depending on the flashing, purge, and air discharge operations. Incidentally, instead of time data such as the predetermined cycle and the elapsed time, a printing data amount such as the number of dots or the combination of the time and the data amount can be used. Hereinafter, timings at which these flashing, purge, and air discharge operations are executed are simply referred to as a "predetermined cycle" as a general term.

The defaults are set so that the flashing, purge, and air discharge operations are executed when power is supplied to the printer 1 by, for example, the connection of the power plug 15 to the commercial power source, and when a man-caused instruction for the recovery operation is given.

When "YES" is inputted in the usage setting section 65 in reply to "1. Do you switch off the power once a week or more?", that is, when the power on/off frequency of the printer 1 is greater than a predetermined frequency (S102: YES), the setting of the recovery operation is changed so that the recovery operation is not performed when the printer 1 is switched on (S103). After the change and when the power on/off frequency is not more than the predetermined frequency (S102: NO), the flow goes to S108.

When "YES" is inputted in the usage setting section 65 in reply to "2. Is the number of printing copies you make 30 sheets per month or more?", that is, when the number of printing copies per predetermined period is greater than a predetermined number (S108: YES), the flow goes to S104 and S106.

At S104, when "YES" (monochrome printing is mainly used) is inputted in the usage setting section 65 in reply to "3. Do you mainly use monochrome printing?" (S104: YES), the recovery cycle of the black ink is set longer than the default value by a predetermined length (S105). At S106, when "YES" (color printing is mainly used) is inputted in the usage setting section 65 in reply to "4. Do you mainly use color printing?" (S106: YES), the recovery cycle of the color inks is set longer than the default value by a predetermined length (S107).

When it is indefinite which of the monochrome printing and the color printing is mainly used (S104: NO, S106: NO), the settings of the recovery cycles of both the black and color inks are changed to values which are greater than the default values by a predetermined length, but shorter than the recovery cycles set at S105 and S107 (S109). When the number of printing copies per predetermined period is not more than the predetermined number (S108: NO), the recovery cycle is not changed.

Then, the recovery operation deciding section 66 outputs these changes to the memories of the flashing control section 62, the purge control section 63, and the air discharge control unit 64 (S111). The flashing control section 62, the purge control section 63, and the air discharge control unit 64 execute the flashing, purge, and air discharge operations respectively based on the settings.

Incidentally, as the recovery operation, the combination of two or more of the flashing, purge, and air discharge operations may be executed, or the single flashing or purge operation may be executed.

By controlling the recovery operation according to the user's usage of the printer 1 as described above, it is possible to prevent the viscosity increase of the ink and prevent the ink from being discharged more than necessary. For example, if a user frequently switches off the printer 1 when not using the printer 1, a time length up to the next switch-on time is short. Therefore, since it is thought that the ink is not affected much and thus does not suffer much viscosity increase, the recovery operation need not be performed every time when the printer is switched on. When the predetermined number of printing copies is made by the monochrome printing or the color printing, the recovery operation with respect to the nozzles 25 corresponding to the colors which are frequency used is made long, which makes it possible to prevent the ink from being discharged more than necessary. Incidentally, when the printer is not frequently switched off or when the number of printing copies made is less than the predetermined number, the recovery operation is performed according to the default setting.

In the above-described embodiment, the number of printing copies is linked with the frequency of the monochrome printing or the color printing, but the recovery operation may be controlled separately based on the former and based on the latter. That is, the recovery cycles of the black and color inks may be set long only based on the fact that the number of printing copies is large, or when the frequency of one of the monochrome printing and the color printing is great, the cycle of the recovery operation with respect to the nozzles 25 corresponding to the colors which are frequently used may be set long.

Figure 7A:
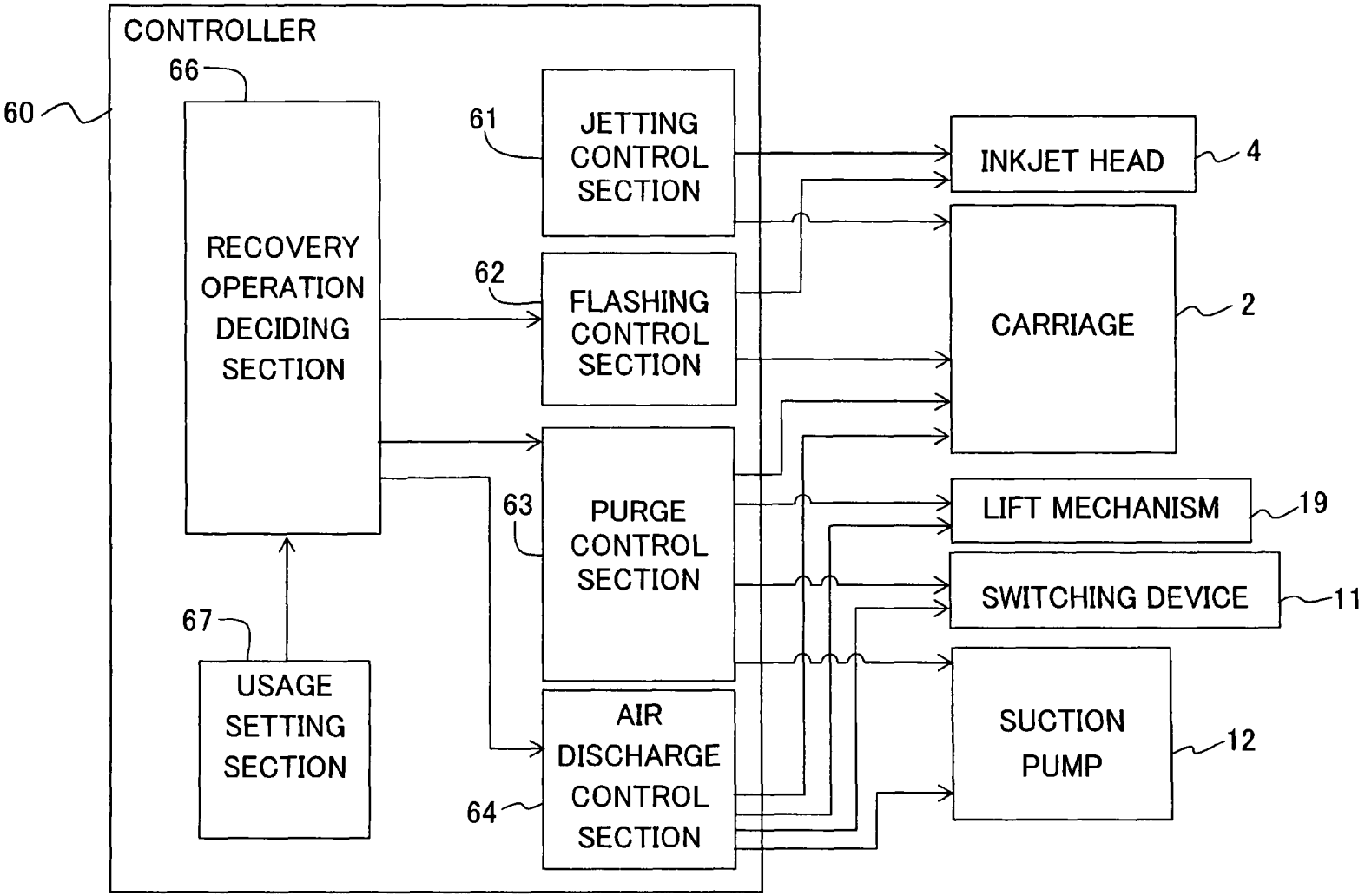
FIG. 7A is a block diagram of a controller in a second embodiment.

FIG. 7A is a block diagram showing the rough configuration of a controller 60 in a printer of a second embodiment. In this embodiment, a usage detecting section 67 is provided as an information obtaining section in place of the usage setting section 65 in the above-described embodiment. The other configuration is the same as that of the above-descried embodiment.

Figure 7B:
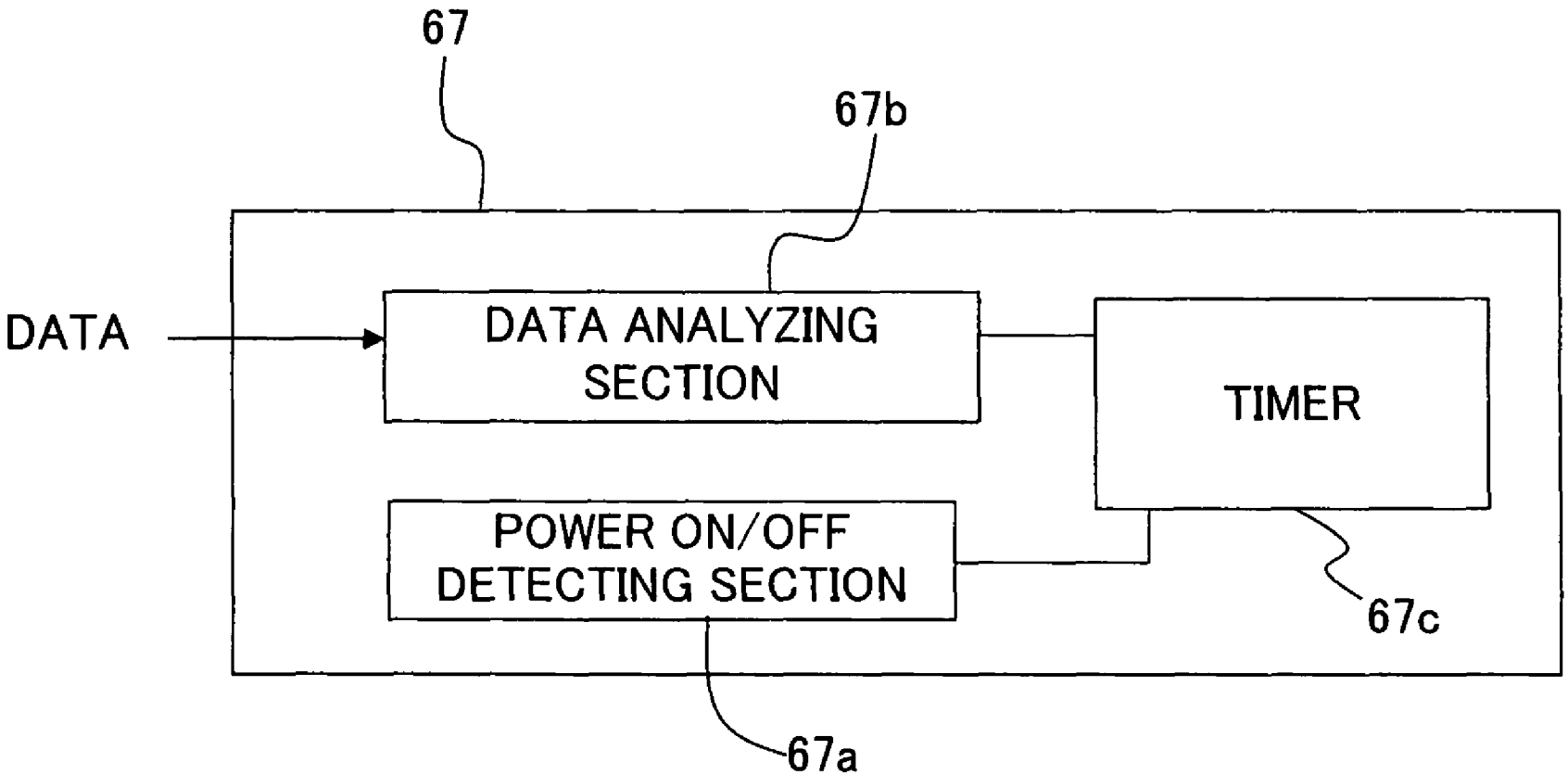
FIG. 7B is a block diagram showing details of a usage detecting section in the controller.

The usage detecting section 67 includes a power on/off detecting section 67*a*, a data analyzing section 67*b*, and a timer 67*c* as shown in FIG. 7B. The timer 67*c* measures an elapsed time in, for example, two weeks or one month. The usage detecting section 67 is backed up by a battery or the like so as to be capable of measuring and holding the time, the number of times, and a data amount even while disconnected from a commercial power source.

The power on/off detecting section 67*a* counts the number of times the printer 1 is switched on/off by the inserting/pulling of the power plug 15, or the like in the aforesaid two weeks or one month. When the printer 1 is switched on/off a predetermined number of times or more, a recovery operation deciding section 66 judges that a power on/off frequency of the printer 1 is high and changes the settings so that the recovery operation is not performed when the printer 1 is switched on, as at S103 in the above-described embodiment. Further, the data analyzing section 67*b* measures a data amount of monochrome printing or color printing based on data printed by a jetting control section 61 in the aforesaid two weeks or one month, and counts the number of printing copies. Based on these measurements, the recovery operation deciding section 66 judges which of the monochrome printing and the color printing is mainly used or judges that it is indefinite which of them is mainly used, and also judges whether or not a predetermined number of printing copies or more have been made in a predetermined period. Then, the recovery operation deciding section 66 sets the recovery cycles of the black and color inks respectively based on the judgment results, as in the above-described embodiment. At this time, the number of printing copies may be linked or need not be linked with the frequency of the monochrome printing or the color printing.

In the aforesaid initial two weeks or one month after the purchase of the printer, the recovery operation deciding section 66 outputs default settings of the recovery operation to memories of a flashing control section 62, a purge control section 63, and an air discharge control unit 64, and causing them to operate according to the default settings of the recovery operation. During this period, a user's usage such as the power on/off frequency, which of monochrome printing and color printing is mainly used, that neither of them is not mainly performed printing, and whether the number of printing copies per predetermined period is large is detected, and the settings of the recovery operation are changed. Then, the settings are output to the flashing control section 62, the purge control section 63, and the air discharge control unit 64. The operations of the flashing control section 62, the purge control section 63, and the air discharge control unit 64 are the same as those in the above-described embodiment.

Incidentally, even after detecting the aforesaid user's use state, the usage detecting section 67 may sequentially perform the detecting operation to update data regarding the user's use state stored in the recovery operation deciding section 66. Further, the usage detecting section 67 can update the aforesaid data stored in the recovery operation deciding section 66 in the predetermined period, by starting the detection of the aforesaid user's use state in response to a user's operation of keys or the like at an arbitrary moment.

Figure 8:
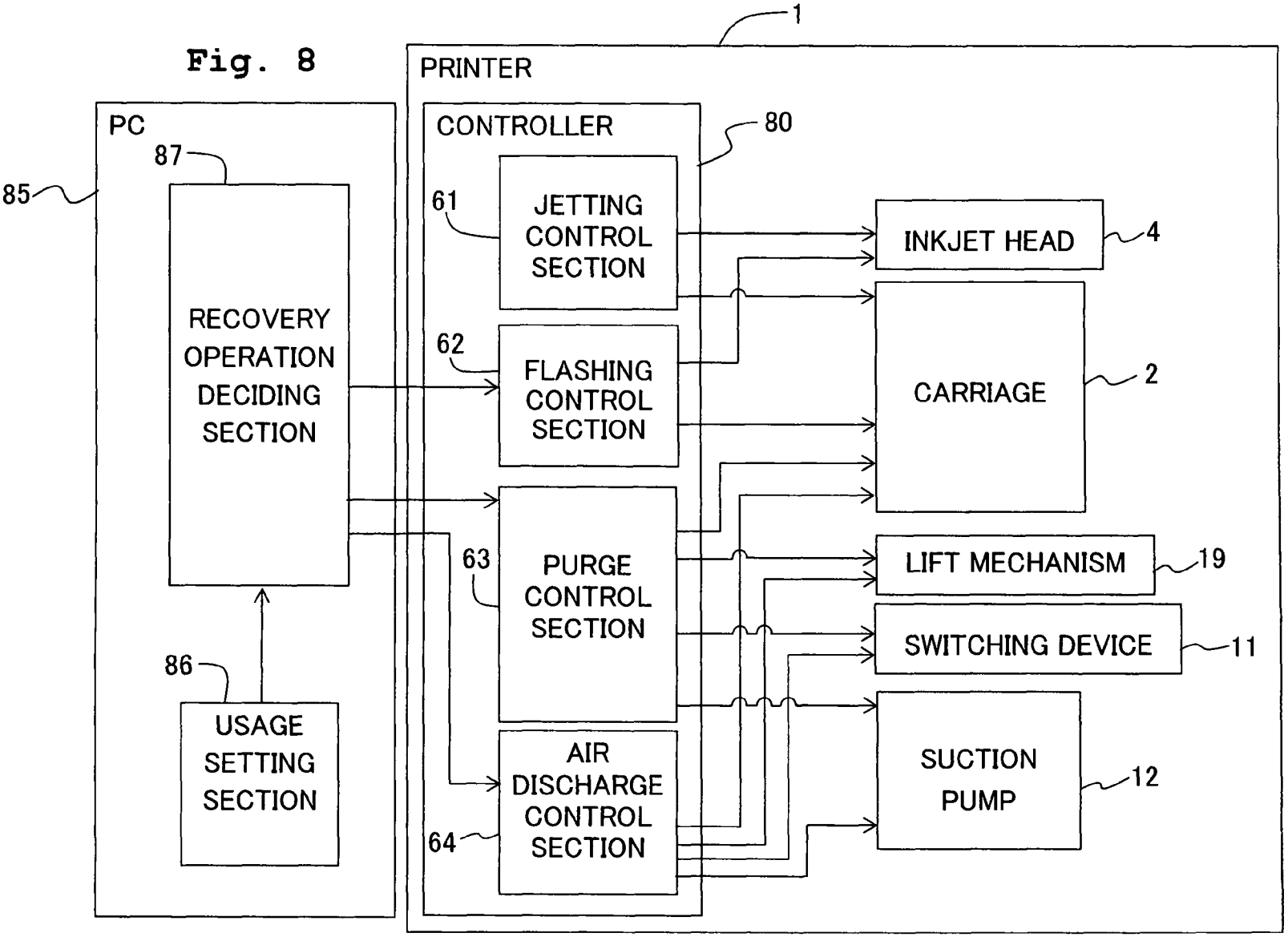
FIG. 8 is a block diagram of a controller in a third embodiment.

FIG. 8 shows a third embodiment. A personal computer (hereinafter, referred to as a PC) 85 (controller) is connected to the printer 1 (image forming apparatus), and the PC 85 includes a usage detecting section 86 as an information obtaining section and a recovery operation deciding section 87. As is generally known, the PC 85 generates image data including text data and transmits the image data to the printer 1 so that the printer 1 prints the image data on a medium. A controller 80 in the printer 1 includes a jetting control section 61, a flashing control section 62, a purge control section 63, and an air discharge control unit 64 as in the above-described embodiments, but does not include the usage detecting section 67 nor the recovery operation deciding section 66 (see FIG. 7A). The usage detecting section 86 and the recovery operation deciding section 87 perform control operation as those of the usage detecting section 67 and the recovery operation deciding section 66, respectively, of the second embodiment. These control operations are realized by a program which is executed by the PC 85. In the third embodiment, the combination of the printer 1 and the PC 85 corresponds to an image forming system according to the present invention.

In this case, the usage detecting section 86, similarly to that in the second embodiment, includes a power on/off detecting section 67*a* and a data analyzing section 67*b*. As the timer 67*c*, a time measuring function of the PC 85 is used. The usage detecting section 86 receives, from the printer 1, signals accompanying on/off of the power in a predetermined period, and the recovery operation deciding section 87, similarly to that of the second embodiment, judges that a power on/off frequency is not less than a predetermined frequency. Further, the usage detecting section 86 analyzes data transmitted to the printer 1 in the predetermined period, to measure a data amount of monochrome printing or color printing and measure the number of printing copies. Based on these measurements, the recovery operation deciding section 87 judges whether the monochrome printing or the color printing is mainly used or that neither of them is mainly performed printing, and further judges whether a predetermined number of printing copies or more have been made in the predetermined period. Then, based on the judgment results, the recovery operation deciding section 87 sets the recovery operation which is to be performed when the printer 1 is switched on, as in the above-described embodiments. Further, it sets the recovery cycles of the black and color inks respectively, and outputs the settings to the flashing control section 62, the purge control section 63, and the air discharge control unit 64 of the printer 1. Then, the flashing, purge, and air discharge operations are executed similarly to those of the first embodiment.

In a fourth embodiment, though not shown, the power on/off detecting section of the usage detecting section 86 of the third embodiment is provided in the printer 1. The power on/off detecting section of the printer 1 detects on/off of the power and transmits the detected result to the PC 85, and the recovery operation deciding section 87 of the PC 85 sets the recovery operation which is to be performed when the printer 1 is switched on. Incidentally, it is preferably that the operation of analyzing data to measure a data amount of monochrome printing or color printing and measure the number of printing copies is performed in the PC 85.

Figure 9:
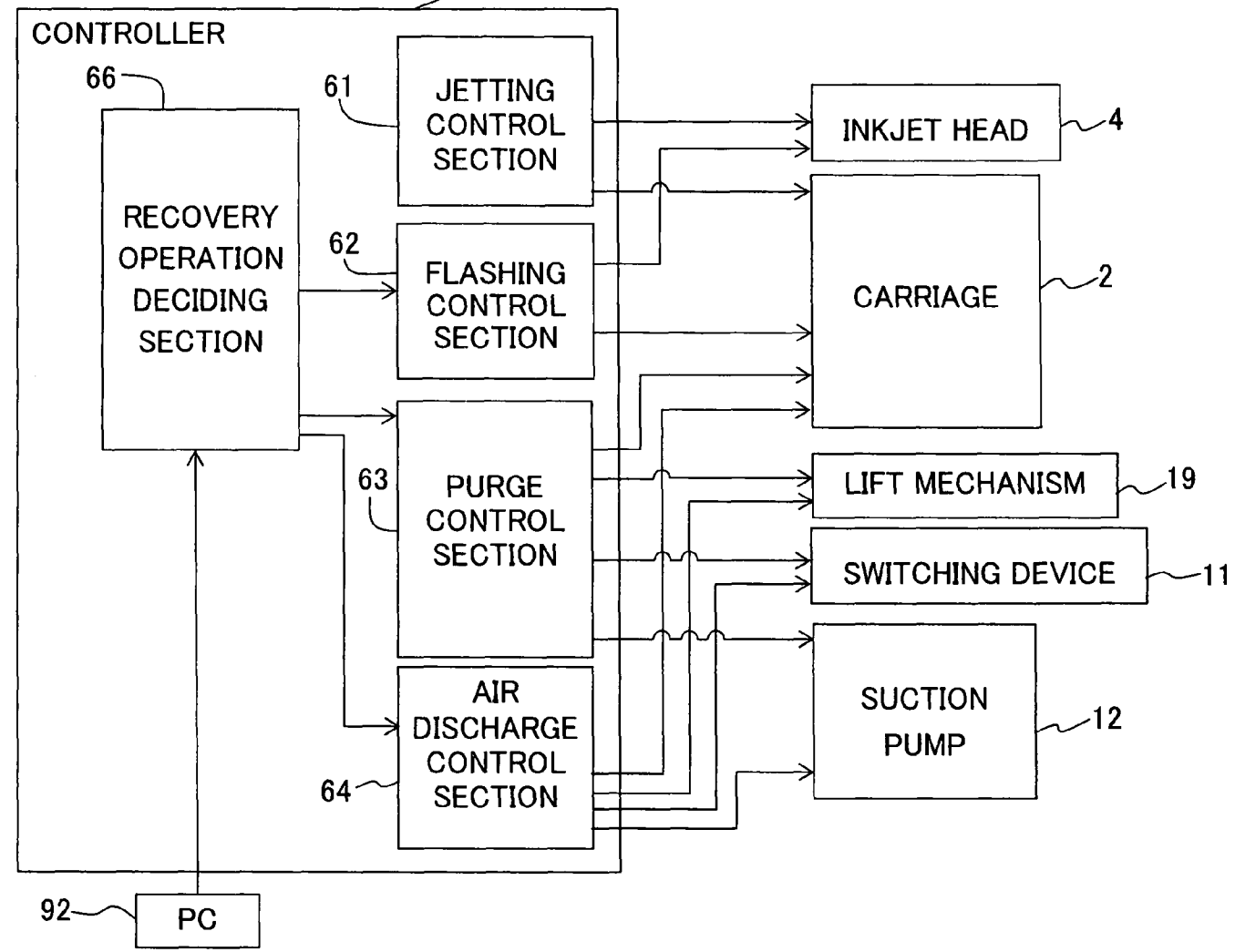
FIG. 9 is a block diagram of a controller in a fifth embodiment.

FIG. 9 shows a fifth embodiment. A personal computer (PC) 92 connected to the printer 1 has the function of the usage setting section 65 in the first embodiment. A user's usage with the same contents as those of the first embodiment is inputted to a recovery operation deciding section 66 of the printer 1 by using a display and an input section of the PC 92. The recovery operation deciding section 66, a flashing control section 62, a purge control section 63, and an air discharge control unit 64 operate similarly to those in the first embodiment.

Figure 10:
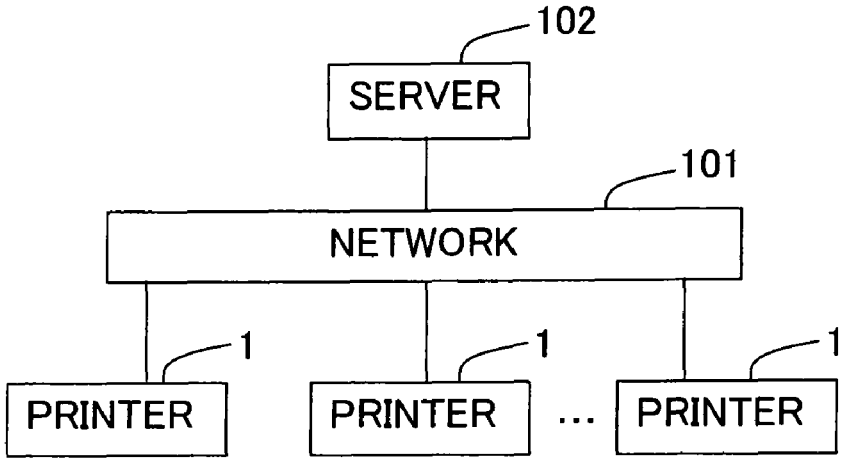
FIG. 10 is a block diagram of a sixth embodiment.

FIG. 10 shows a sixth embodiment. A plurality of the printers 1 (image forming apparatuses) are connected to a server 102 (controller) via a network 101. The server 102 has therein recovery operation deciding sections corresponding to the respective printers 1. A usage detecting section or a usage setting section may be included either in the printer 1 or in the server 102. The recovery operation deciding section, the usage detecting section, and the usage setting section are the same as those described in the above-described embodiments. With these sections, the server 102 detects or receives a user's usage of each of the printer 1, and sets the recovery operations according to the detected usages. Then, the server 102 outputs signals indicating the settings of the recovery operations to the corresponding printers 1. In this embodiment, the combination of the plural printers 1 and the server 102 corresponds to an image forming system according to the present invention.

Figure 11:
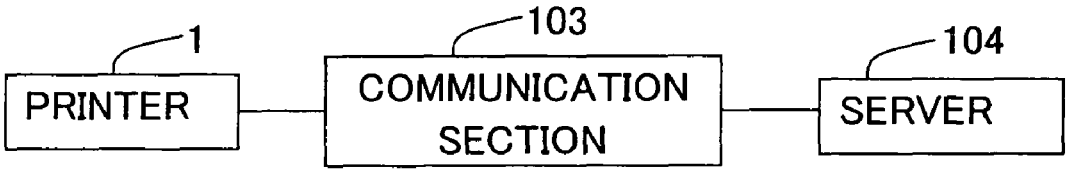
FIG. 11 is a block diagram of a seventh embodiment.

FIG. 11 shows a seventh embodiment. The printer 1 is connected to a server 104 (controller) via a communication section 103. When the printer 1 and a personal computer (PC: first controller) are connected, the PC as the communication section 103 is connected to the server 104 (second controller) via a public communication line using the Internet system.

The printer 1 or the PC includes the usage detecting section or the usage setting section as an information obtaining section described in the above embodiments, and the usage detected or inputted as described above and the model name of the printer are transmitted to the external server 104 via the communication unit 103. The server 104 includes the recovery operation deciding section described in the above embodiments, and based on the aforesaid usage and model name of the printer, the server 104 changes the setting of the recovery operation to transmit the changed setting to the communication unit 103. The communication unit 103 further transmits the setting to the memories of the flashing control section 62, the purge control section 63, and the air discharge control unit 64 of the printer 1. Then, the printer 1 executes the flashing, purge, and air discharge operations in the same manner as in the above embodiments.

An eighth embodiment, though not shown, is basically the same as the seventh embodiment. When the printer 1 is provided as a printing function unit of a facsimile machine (image forming apparatus), a telephone function built in the facsimile machine is connected as a communication section to a server 104 (controller) via a public telephone line. The operation of this system is the same as that of the seventh embodiment.

In these image forming systems, the power on/off frequency of the printer, the use frequencies of the plural kinds of liquids, and the use frequency of a medium which are inputted or detected as the user's usage are the same as those of the first and second embodiments, and other usages may be inputted or detected.

Further, in the above-described embodiments, based on the comparison between the frequency of the monochrome printing and the frequency of the color printing, the recovery cycles of the black ink and the color inks are set, but the use frequency of each of the black, yellow, cyan, and magenta inks may be detected, and according to the detected use frequencies, the recovery cycles of these four kinds of inks may be individually set. However, in this case, it is necessary that the purge cap has separate capping parts corresponding to the nozzles 25 jetting the inks of these colors respectively.

Further, in the above-described embodiments, when the monochrome printing is mainly performed in the printer 1, the recovery cycle of the black ink is made longer by the predetermined length, but in this case, the recovery cycle of the black ink may be set so that the recovery cycle of the black ink becomes longer as the frequency of the monochrome printing is greater. Further, in the above-described embodiments, when the color printing is mainly performed in the printer 1, the recovery cycle of the color inks is made longer by the predetermined length, but in this case, the recovery cycle of the color inks may be set so that the recovery cycle of the color inks becomes longer as the frequency of the color printing is greater.

Further, in the above-described embodiments, the recovery cycle is set longer by the predetermined length when an average number of printing copies is greater than the predetermined number, but the recovery cycle may be set so that the recovery cycle becomes longer as the average number of printing copies is greater.

Further, in the foregoing description, the present invention is applied to the printer performing printing by jetting the ink, but the present invention is applicable not only to an apparatus jetting ink but also to an apparatus jetting any of various kinds of liquids, such as an apparatus applying coloring liquid in a pattern form on a medium to fabricate a color filter of a liquid display device.

What is claimed is:

1. An image forming apparatus comprising:

a liquid jetting head which jets a liquid to form an image;

a recovery mechanism which recovers jetting performance of the liquid jetting head by discharging the liquid in the liquid jetting head to outside of the liquid jetting head;

a controller which controls an operation of the recovery mechanism; and an information obtaining section which obtains an information about a usage of the image forming apparatus selected from the group consisting of a power on/off frequency of the image forming apparatus, a use frequency of the liquid, and a use frequency of a medium receiving the liquid jetted from the liquid jetting head;

wherein the controller controls the recovery mechanism based on the information obtained by the information obtaining section.

2. The image forming apparatus according to claim 1;

wherein the information obtaining section includes a usage detecting section which detects the usage of the image forming apparatus.

3. The image forming apparatus according to claim 2;

wherein the usage detecting section includes a detecting section which detects the power on/off frequency of the image forming apparatus;

wherein, in a case that the power on/off frequency is not more than a predetermined frequency, the controller controls the recovery mechanism to discharge the liquid in the liquid jetting head when the image forming apparatus is switched on; and wherein, in a case that the power on/off frequency is greater than the predetermined frequency, the controller controls the recovery mechanism not to discharge the liquid in the liquid jetting head when the image forming apparatus is switched on.

4. The image forming apparatus according to claim 2;

wherein the usage detecting section includes a detecting section which detects a usage of the image forming apparatus based on data for forming the image; and wherein the controller controls the recovery mechanism based on the usage of the image forming apparatus detected based on the data for forming the image.

5. The image forming apparatus according to claim 2;

wherein the liquid includes a plurality of kinds of liquids;

wherein the liquid jetting head is provided as a plurality of liquid jetting heads for the plurality of kinds of liquids respectively;

wherein the usage detecting section includes a detecting section which detects the use frequency of each of the liquids;

wherein the controller controls the recovery mechanism to recover the jetting performance of each of the liquid jetting heads at a predetermined recovery cycle; and wherein, when the use frequency of a liquid among the liquids is greater than the use frequency of the other liquids, the controller controls the recovery mechanism to make a recovery cycle, of a liquid jetting head among the liquid jetting heads corresponding to the liquid of which use frequency is greater, longer than the predetermined recovery cycle.

6. The image forming apparatus according to claim 2;

wherein the usage detecting section includes a detecting section which detects the use frequency of the medium receiving the liquid jetted from the liquid jetting head;

wherein the controller controls the recovery mechanism to recover the jetting performance of the liquid jetting head at a predetermined recovery cycle; and wherein, when the use frequency of the medium is greater than a predetermined value, the controller controls the recovery mechanism to make a recovery cycle longer than the predetermined recovery cycle.

7. The image forming apparatus according to claim 1;

wherein the information obtaining section includes an input section via which the power on/off frequency is inputted;

wherein, in a case that the power on/off frequency is not more than a predetermined frequency, the controller controls the recovery mechanism to discharge the liquid in the liquid jetting head when the image forming apparatus is switched on; and wherein, in a case that the power on/off frequency is greater than the predetermined frequency, the controller controls the recovery mechanism not to discharge the liquid in the liquid jetting head when the image forming apparatus is switched on.

8. The image forming apparatus according to claim 1;

wherein the liquid includes a plurality of kinds of liquids;

wherein the liquid jetting head is provided as a plurality of liquid jetting heads for the plurality of kinds of liquids respectively;

wherein the information obtaining section includes an input section via which a relative use frequency of each of the liquids is input;

wherein the controller controls the recovery mechanism to recover the jetting performance of each of the liquid jetting heads at a predetermined cycle; and wherein, when the use frequency of a liquid among the liquids is greater than the use frequency of the other liquids, the controller controls the recovery mechanism to make a recovery cycle, of a liquid jetting head among the liquid jetting heads corresponding to the liquid of which use frequency is greater, longer than the predetermined recovery cycle.

9. The image forming apparatus according to claim 1;

wherein the information obtaining section includes an input section via which the use frequency of the medium receiving the liquid jetted from the liquid jetting head is inputted;

wherein the controller controls the recovery mechanism to recover the jetting performance of the liquid jetting head at a predetermined cycle; and wherein, when the use frequency of the medium is greater than a predetermined value, the controller controls the recovery mechanism to make a recovery cycle longer than the predetermined recovery cycle.

10. An image forming system comprising:

an image forming apparatus including a liquid jetting head which jets a liquid to form an image and a recovery mechanism which recovers jetting performance of the liquid jetting head by discharging the liquid in the liquid jetting head to outside of the liquid jetting head;

a controller which is connected to the image forming apparatus and which transmits, to the image forming apparatus, data with which the image forming apparatus forms the image; and an information obtaining section which obtains an information about a usage of the image forming apparatus selected from the group consisting of a power on/off frequency of the image forming apparatus, a use frequency of the liquid, and a use frequency of a medium receiving the liquid jetted from the liquid jetting head.

11. The image forming system according to claim 10;

wherein the controller includes an input section as the information obtaining section via which the usage of the image forming apparatus is inputted; and the controller transmits, to the image forming apparatus, a signal controlling the recovery mechanism based on the usage of the image forming apparatus which is inputted via the input section.

12. The image forming system according to claim 11;

wherein the usage of the image forming apparatus is the power on/off frequency of the image forming apparatus;

wherein, in a case that the power on/off frequency is not more than a predetermined frequency, the controller transmits, to the image forming apparatus, a signal controlling the recovery mechanism to discharge the liquid in the liquid jetting head when the power of the image forming apparatus is on; and wherein, in a case that the power on/off frequency is greater than the predetermined frequency, the controller transmits, to the image forming apparatus, a signal controlling the recovery mechanism not to discharge the liquid in the liquid jetting head when the image forming apparatus is switched on.

13. The image forming system according to claim 11;

wherein the liquid includes a plurality of kinds of liquids;

wherein the liquid jetting head is provided as a plurality of liquid jetting heads for the plurality of kinds of liquids respectively;

wherein the usage of the image forming apparatus is a relative use frequency among the liquids;

wherein the controller transmits, to the image forming apparatus, a signal controlling the recovery mechanism to recover the jetting performance of each of the liquid jetting heads at a predetermined cycle; and wherein, in a case that an use frequency of a liquid among the liquids is greater than a use frequency of the other liquids, the controller transmits, to the image forming apparatus, a signal controlling the recovery mechanism to make a recovery cycle, of a liquid jetting head among the liquid jetting head corresponding to the liquid of which use frequency is greater, longer than the predetermined recovery cycle.

14. The image forming system according to claim 11;

wherein the usage of the image forming apparatus is the use frequency of the medium receiving the liquid jetted from the liquid jetting head;

wherein the controller transmits, to the image forming apparatus, a signal controlling the recovery mechanism to recover the jetting performance of the liquid jetting head at a predetermined recovery cycle; and wherein, when the use frequency of the medium is greater than a predetermined value, the controller transmits, to the image forming apparatus, a signal controlling the recovery mechanism to make the recovery cycle longer than the predetermined recovery cycle.

15. The image forming system according to claim 10;

wherein the controller includes a usage detecting section as the information obtaining section which detects the usage of the image forming apparatus, and transmits, to the image forming apparatus, a signal controlling the recovery mechanism based on the usage of the image forming apparatus, which is detected by the usage detecting section.

16. The image forming system according to claim 15;

wherein the usage of the image forming apparatus is the power on/off frequency of the image forming apparatus, and in a case that the power on/off frequency is not more than a predetermined frequency;

wherein the controller transmits, to the image forming apparatus, a signal controlling the recovery mechanism to discharge the liquid in the liquid jetting head when the image forming apparatus is switched on;

wherein, in a case that the power on/off frequency is greater than the predetermined frequency, the controller transmits, to the image forming apparatus, a signal controlling the recovery mechanism not to discharge the liquid in the liquid jetting head when the image forming apparatus is switched on.

17. The image forming system according to claim 15;
wherein the liquid includes a plurality of kinds of liquids;
wherein the liquid jetting head is provided as a plurality of liquid jetting heads for the plurality of kinds of liquids respectively;
wherein the usage of the image forming apparatus is a relative use frequency of each of the liquids,
wherein the controller transmits, to the image forming apparatus, a signal controlling the recovery mechanism to recover the jetting performance of each of the liquid jetting heads at a predetermined cycle; and
wherein, when the use frequency of a liquid among the liquids is greater than the use frequency of the other liquids, the controller transmits, to the image forming apparatus, a signal controlling the recovery mechanism to make a recovery cycle, of the liquid jetting head of a liquid jetting head among the liquid jetting heads corresponding to the liquid of which use frequency is greater, longer than the predetermined recovery cycle.

18. The image forming system according to claim 15;
wherein the usage of the image forming apparatus is the use frequency of the medium receiving the liquid jetted from the liquid jetting head;
wherein the controller transmits, to the image forming apparatus, a signal controlling the recovery mechanism to recover the jetting performance of the liquid jetting head at a predetermined recovery cycle; and
wherein when the use frequency of the medium is greater than a predetermined value, the controller transmits, to the image forming apparatus, a signal controlling the recovery mechanism to make the recovery cycle longer than the predetermined recovery cycle.

19. The image forming system according to claim 10;
wherein the image forming apparatus includes a usage detecting section as the information obtaining section which detects the usage of the image forming apparatus, and the controller transmits, to the image forming apparatus, a signal controlling the recovery mechanism based on the usage of the image forming apparatus, which is detected by the usage detecting section and received from the image forming apparatus.

20. The image forming system according to claim 19;
wherein the usage of the image forming apparatus is the power on/off frequency of the image forming apparatus;
wherein, in a case that the power on/off frequency is not more than a predetermined frequency, the controller transmits, to the image forming apparatus, a signal controlling the recovery mechanism to discharge the liquid in the liquid jetting head when the image forming apparatus is switched on; and
wherein, in a case that the power on/off frequency is greater than the predetermined frequency, the controller transmits, to the image forming apparatus, a signal controlling the recovery mechanism not to discharge the liquid in the liquid jetting head when the image forming apparatus is switched on.

21. The image forming system according to claim 19;
wherein the liquid includes a plurality of kinds of liquids;
wherein the liquid jetting head is provided as a plurality of liquid jetting heads for the plurality of kinds of liquids respectively;
wherein the usage of the image forming apparatus is a relative use frequency of each of the liquids, the controller transmits, to the image forming apparatus, a signal controlling the recovery mechanism to recover the jetting performance of each of the liquid jetting heads at a predetermined cycle; and
wherein, when the use frequency of a liquid among the liquids is greater than the use frequency of the other liquids, the controller transmits, to the image forming apparatus, a signal controlling the recovery mechanism to make a recovery cycle, of a liquid jetting head among the liquid jetting heads corresponding to the liquid of which use frequency is greater, longer than the predetermined recovery cycle.

22. The image forming system according to claim 19;
wherein the usage of the image forming apparatus is the use frequency of the medium receiving the liquid jetted from the liquid jetting head;
wherein the controller transmits, to the image forming apparatus, a signal controlling controls the recovery mechanism to recover the jetting performance of the liquid jetting head at a predetermined recovery cycle; and
wherein, when the use frequency of the medium is greater than a predetermined value, the controller transmits, to the image forming apparatus, a signal controlling the recovery mechanism to make the recovery cycle longer than the predetermined recovery cycle.

23. The image forming system according to claim 10;
wherein the image forming apparatus and the controller are connected to each other via a communication line;
wherein the image forming apparatus includes an input section as the information obtaining section to which the usage of the image forming apparatus is input; and
wherein the controller transmits, to the image forming apparatus, a signal controlling the recovery mechanism based on the usage input from the image forming apparatus via the communication line.

24. The image forming system according to claim 23;
wherein the usage of the image forming apparatus is the power on/off frequency of the image forming apparatus;
wherein, in a case that the power on/off frequency is not more than a predetermined frequency, the controller transmits, to the image forming apparatus, a signal controlling the recovery mechanism to discharge the liquid in the liquid jetting head when the image forming apparatus is switched on; and
wherein, in a case that the on/off frequency is greater than the predetermined frequency, the controller transmits, to the image forming apparatus, a signal controlling the recovery mechanism not to discharge the liquid in the liquid jetting head when the image forming apparatus is switched on.

25. The image forming system according to claim 23;
wherein, the liquid includes a plurality of kinds of liquids; the liquid jetting head is provided as a plurality of liquid jetting heads for the plurality of kinds of the liquids respectively;
wherein the usage of the image forming apparatus is a relative use frequency of each of the liquids;
wherein the controller transmits, to the image forming apparatus, a signal controlling the recovery mechanism to recover the jetting performance of each of the liquid jetting heads at a predetermined cycle; and
wherein, when the use frequency of a liquid among the liquids is greater than the use frequency of the other liquids, the controller transmits, to the image forming apparatus, a signal controlling the recovery mechanism to make a recovery cycle, of a liquid jetting head among the liquid jetting heads corresponding to the liquid of which use frequency is greater, longer than the predetermined recovery cycle.

26. The image forming system according to claim 23;

wherein the usage of the image forming apparatus is the use frequency of the medium receiving the liquid jetted from the liquid jetting head;

wherein the controller transmits, to the image forming apparatus, a signal controlling the recovery mechanism to recover the jetting performance of the liquid jetting head at a predetermined recovery cycle; and wherein, when the use frequency of the medium is greater than a predetermined value, the controller transmits, to the image forming apparatus, a signal controlling the recovery mechanism to make the recovery cycle longer than the predetermined recovery cycle.

27. The image forming system according to claim 20;

wherein the image forming apparatus and the controller are connected to each other via a communication line.

28. The image forming system according to claim 21;

wherein the image forming apparatus and the controller are connected to each other via a communication line.

29. The image forming system according to claim 22;

wherein the image forming apparatus and the controller are connected to each other via a communication line.

30. The image forming system according to claim 10;

wherein the controller is connected to the image forming apparatus and includes;

a first controller transmitting, to the image forming apparatus, data based on which the image forming apparatus forms the image; and a second controller connected to the first controller via a communication line;

wherein the image forming apparatus includes a usage detecting section as the information obtaining section which detects the usage of the image forming apparatus;

wherein the first controller outputs, to the second controller, the usage input from the image forming apparatus; and wherein the second controller transmits a signal controlling the recovery mechanism based on the usage, to the image forming apparatus via the first controller.

31. The image forming system according to claim 30;

wherein the usage of the image forming apparatus is the power on/off frequency of the image forming apparatus;

wherein, in a case that the power on/off frequency is not more than a predetermined frequency, the second controller transmits, to the image forming apparatus, a signal controlling the recovery mechanism to discharge the liquid in the liquid jetting head when the image forming apparatus is switched on; and wherein, in a case that the power on/off frequency is greater than the predetermined frequency, the controller transmits, to the image forming apparatus, a signal controlling the recovery mechanism not to discharge the liquid in the liquid jetting head when the image forming apparatus is switched on.

32. The image forming system according to claim 30;

wherein the liquid includes a plurality of kinds of liquids;

wherein the liquid jetting head is provided as a plurality of liquid jetting heads for the plurality of kinds of liquids respectively;

wherein the usage of the image forming apparatus is a relative use frequency of each of the liquids;

wherein the second controller transmits, to the image forming apparatus, a signal controlling the recovery mechanism to recover the jetting performance of each of the liquid jetting heads at a predetermined cycle; and wherein, when the use frequency of a liquid among the liquids is greater than the use frequency of the other liquids, the second controller transmits, to the image forming apparatus, a signal controlling the recovery mechanism to make a recovery cycle, of a liquid jetting head among the liquid jetting heads corresponding to the liquid of which use frequency is greater, longer than the predetermined recovery cycle.

33. The image forming system according to claim 30;

wherein the usage of the image forming apparatus is the use frequency of the medium receiving the liquid jetted from the liquid jetting head;

wherein the second controller transmits, to the image forming apparatus, a signal controlling the recovery mechanism to recover the jetting performance of the liquid jetting head at a predetermined recovery cycle; and wherein, when the use frequency of the medium is greater than a predetermined value, the second controller transmits, to the image forming apparatus, a signal controlling the recovery mechanism to make the recovery cycle longer than the predetermined recovery cycle.

34. The image forming system according to claim 10;

wherein the controller is connected to the image forming apparatus and includes a first controller transmitting, to the image forming apparatus, data based on which the image forming apparatus forms the image; and a second controller connected to the first controller via a communication line;

wherein the first controller includes an input section as the information obtaining section to which the usage of the image forming apparatus is input, and outputs, to the second controller, the usage input via the input section; and wherein the second controller transmits a signal controlling the recovery mechanism based on the usage, to the image forming apparatus via the first controller.

35. The image forming system according to claim 34;

wherein the usage of the image forming apparatus is the power on/off frequency of the image forming apparatus;

wherein, in a case that the power on/off frequency is not more than a predetermined frequency, the second controller transmits, to the image forming apparatus, a signal controlling the recovery mechanism to discharge the liquid in the liquid jetting head when the image forming apparatus is on; and wherein, in a case that the power on/off frequency is greater than the predetermined frequency, the controller transmits, to the image forming apparatus, a signal controlling the recovery mechanism not to discharge the liquid in the liquid jetting head when the image forming apparatus is switched on.

36. The image forming system according to claim 34;

wherein the liquid includes a plurality of kinds of liquids;

wherein the liquid jetting head is provided as a plurality of liquid jetting heads for the plurality of kinds of liquids respectively;

wherein the usage of the image forming apparatus is a relative use frequency of each of the liquids;

wherein the second controller transmits, to the image forming apparatus, a signal controlling the recovery mechanism to recover the jetting performance of each of the liquid jetting heads at a predetermined cycle; and wherein, when the use frequency of a liquid among the liquids is greater than the use frequency of the other liquids, the second controller transmits, to the image forming apparatus, a signal controlling the recovery mechanism to make a recovery cycle, of a liquid jetting head among the liquid jetting heads corresponding to the liquid of which use frequency is greater, longer than the predetermined recovery cycle.

37. The image forming system according to claim 34;

wherein the usage of the image forming apparatus is the use frequency of a medium receiving the liquid jetted from the liquid jetting head;

wherein the second controller transmits, to the image forming apparatus, a signal controlling the recovery mechanism to recover the jetting performance of the liquid jetting head at a predetermined recovery cycle; and wherein, when the use frequency of the medium is greater than a predetermined value, the second controller transmits, to the image forming apparatus, a signal controlling the recovery mechanism to make the recovery cycle longer than the predetermined recovery cycle.

* * * * *